US012590577B2

(12) United States Patent
Ferrara et al.

(10) Patent No.: US 12,590,577 B2
(45) Date of Patent: Mar. 31, 2026

(54) SNAP-ON GETTER PUMP ASSEMBLY AND ITS USE

(71) Applicant: SAES GETTERS S.P.A., Lainate (IT)

(72) Inventors: Alessandro Ferrara, S. Giorgio su Legnano (IT); Michele Mura, Arona (IT)

(73) Assignee: SAES Getters S.p.A., Lainate (IT)

( * ) Notice: Subject to any disclaimer, the term of this patent is extended or adjusted under 35 U.S.C. 154(b) by 0 days.

(21) Appl. No.: 18/997,873

(22) PCT Filed: Jul. 28, 2023

(86) PCT No.: PCT/EP2023/071094
§ 371 (c)(1),
(2) Date: Jan. 23, 2025

(87) PCT Pub. No.: WO2024/028240
PCT Pub. Date: Feb. 8, 2024

(65) Prior Publication Data

US 2025/0264093 A1 Aug. 21, 2025

(30) Foreign Application Priority Data

Aug. 1, 2022 (IT) ..... 102022000016272

(51) Int. Cl.
*F04B 37/06* (2006.01)
*F04B 39/14* (2006.01)

(52) U.S. Cl.
CPC ..... *F04B 37/06* (2013.01); *F04B 39/14* (2013.01)

(58) Field of Classification Search
CPC ..... F04B 37/06; F04B 39/14; F04B 37/02; F04B 37/14; F04B 39/12; F04B 39/121; H01J 7/18; H01J 21/20; H01J 2893/003
USPC ..... 417/50, 51, 360
See application file for complete search history.

(56) References Cited

U.S. PATENT DOCUMENTS 2,356,035 A * 8/1944 Downing ..... H01J 21/20 313/549
3,176,179 A * 3/1965 Kuehne ..... H01J 3/027 313/237
3,221,201 A * 11/1965 Free ..... H01J 7/186 313/546
3,327,929 A * 6/1967 Dillenbeck ..... H01J 7/18 417/49

(Continued)

FOREIGN PATENT DOCUMENTS

EP 0742370 A1 11/1996
EP 0753663 A1 1/1997
WO WO-9402957 A1 2/1994

OTHER PUBLICATIONS

International Search Report and Written Opinion issued Oct. 27, 2023 in PCT/EP2023/071094, 15 pages.

*Primary Examiner* — Mark A Laurenzi
*Assistant Examiner* — Benjamin Doyle
(74) *Attorney, Agent, or Firm* — Element IP, PLC

(57) ABSTRACT

Snap-on getter pump assembly where a first part, a getter subassembly (10; 20; 30; 40), is firmly but reversibly coupled with a second part, holding the getter heater (50) and a closed cable module (57; 67), and such assembly of these two parts is easily installed through plugging and screwing into a support comprising a matching plug-and-socket type connection.

27 Claims, 5 Drawing Sheets

(56) References Cited

U.S. PATENT DOCUMENTS

| | | | | | |
|---|---|---|---|---|---|
| 3,780,501 | A * | 12/1973 | Porta | H01J 7/18 | 417/51 |
| 5,154,582 | A * | 10/1992 | Danielson | B01J 3/006 | 417/51 |
| 5,772,404 | A * | 6/1998 | Carella | F04B 37/02 | 417/313 |
| 6,074,171 | A * | 6/2000 | Giannantonio | F04B 37/02 | 417/51 |
| 2017/0076925 | A1* | 3/2017 | Bonucci | H01J 41/12 | |
| 2023/0128669 | A1* | 4/2023 | Thierley | F04B 39/12 | 417/49 |

* cited by examiner

SNAP-ON GETTER PUMP ASSEMBLY AND ITS USE

The present invention is inherent to a new getter pump assembly namely a snap-on assembly where a first part, a getter subassembly, is firmly but reversibly coupled with a second part, holding the getter heater and a closed cable module, and such assembly of these two parts is easily installed through plugging and screwing into a support comprising a matching plug-and-socket type connection.

Getter pumps are known since a long time, as for example described in EP0742370, relating to a getter pump in which a heater is coaxially inserted within a hollow support of a plurality of disk-shaped getter elements to form a so-called "getter stack". Such an arrangement provides for a very compact getter stack but it requires a heater for each getter stack, whereby in the case of a getter pump comprising multiple getter stacks the structure becomes quite expensive and complicated. In fact, since each heater must be supplied with current through a corresponding wire, the assembly/disassembly and maintenance of the getter pump becomes labour-intensive.

Getter pumps are getting more diffused use and appreciated thanks also to continuous improvements, such as for example with regards to the characteristics of getter alloys used in the getter pump as described in the international patent applications WO2013175340, WO2015075648, WO2017203015, or new advantageous configurations such as described in the international patent applications WO2010105944, WO2014060879, WO2015150974, WO2015198235.

More specifically, the configuration described in WO2015198235 allows the use of a high number of getter pumping elements directly placed in specific portions of bulk devices and structures such as particle accelerator rings, and represents the current state of the art for putting a high number of getter pumps in a closed environment.

In view of this, there is the need not only to address the getter pumps features from an operational standpoint, aspect already successfully addressed by the aforementioned technical solutions, but also to make easier their installation and servicing.

Purpose of the present invention is therefore to provide a new getter pump structure generally improving installation and service ease, aspects of relevance in high density configurations, i.e. when the pumps are packed onto a wall of the system to be evacuated or installed close to each other in a supporting structure to be placed and mounted in the final device. In a first aspect, the invention consists in a snap-on getter pumping element comprising a getter module subassembly, a heater module subassembly and a closed cable module wherein:

a. the getter module subassembly contains one or more getter stacks and has a case with a grid-like side wall on its external surface and two metallic bases fixed to the grid-like side wall, with the base to be coupled to the heater module subassembly being holed in its center, said metallic bases having positioning means for said one or more getter stacks that are disposed around a central empty space within the getter subassembly case;

b. a heater module subassembly with one or more heaters mounted in the central position of a first surface of a heater subassembly base, said one or more heaters being insertable in the central empty space of the getter subassembly case via the holed getter subassembly base, c. a closed cable module mounted on a second surface of the heater subassembly base, opposite to the first surface, and having electrical connectors on its surface opposite with respect to the one in contact with the heater module subassembly, wherein the getter module subassembly and the heater module subassembly are firmly but reversibly joined via coupling elements and at least two floating threaded rods project from the second surface of the heater module subassembly base.

The invention will be further illustrated with the help of non-limiting figures where:

Figure 5A:
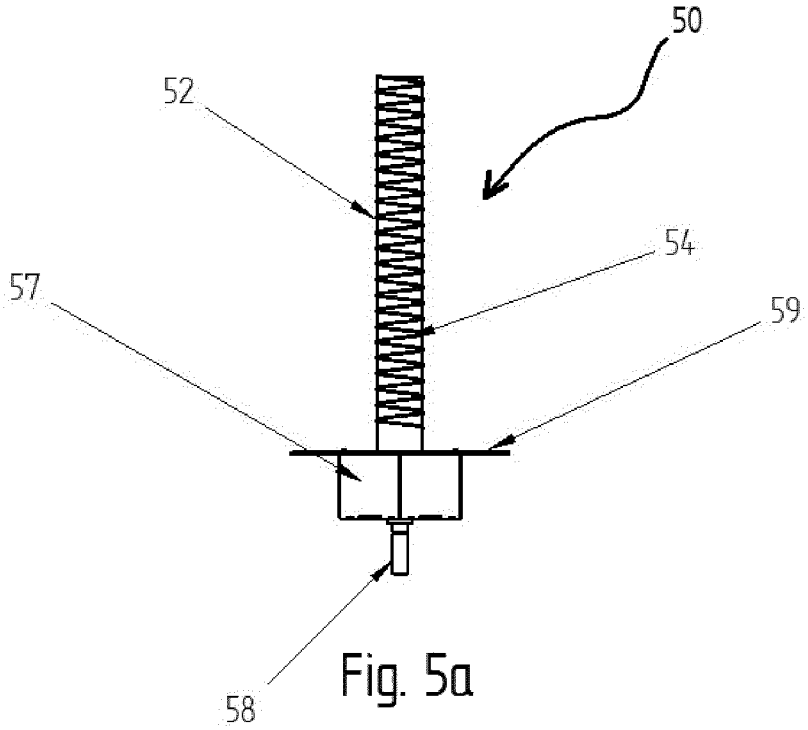
Figure 5B:
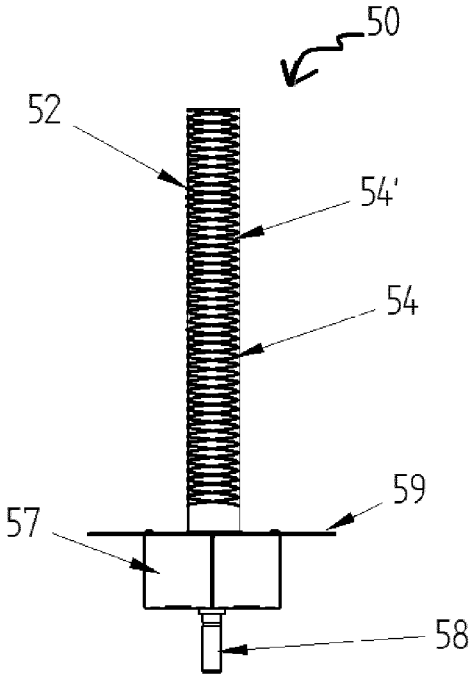
Figure 5C:
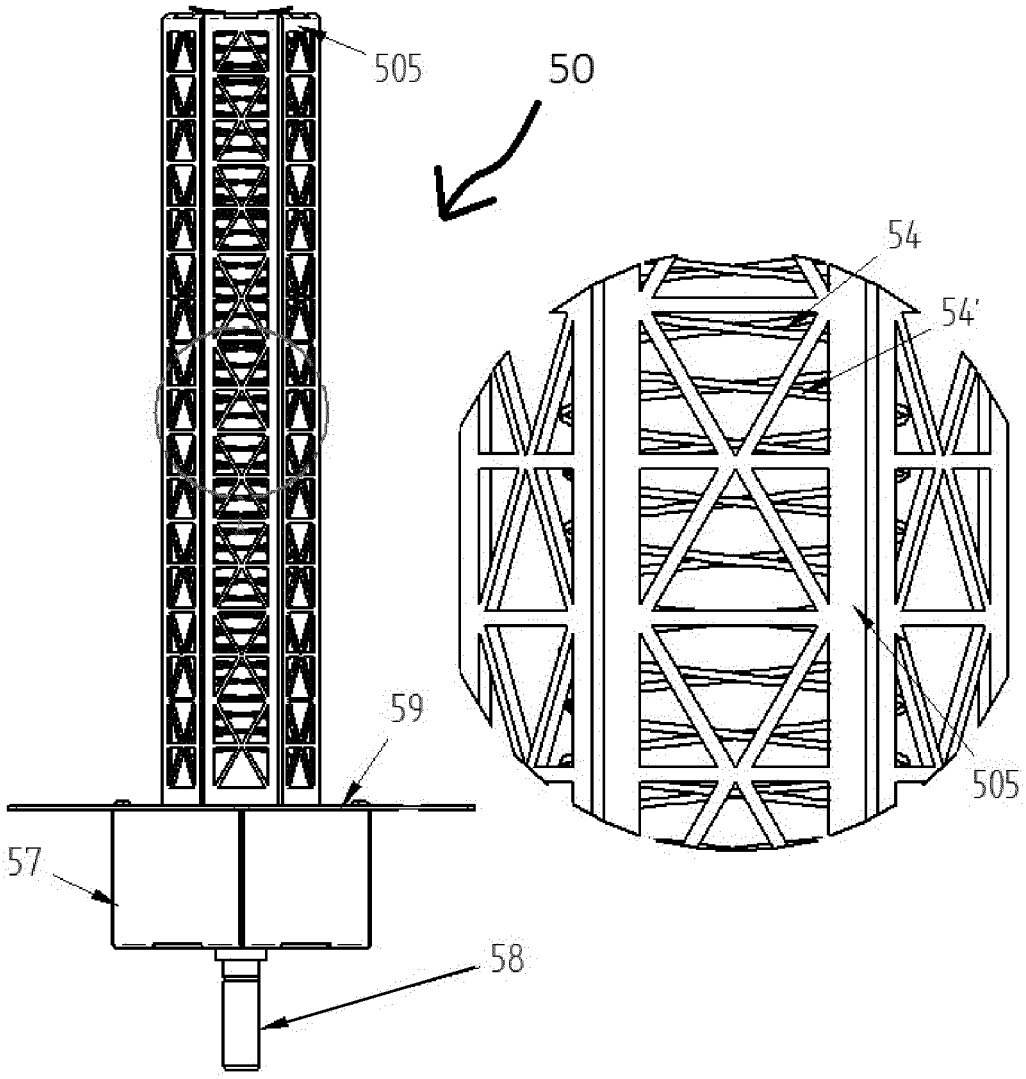
Figure 6:
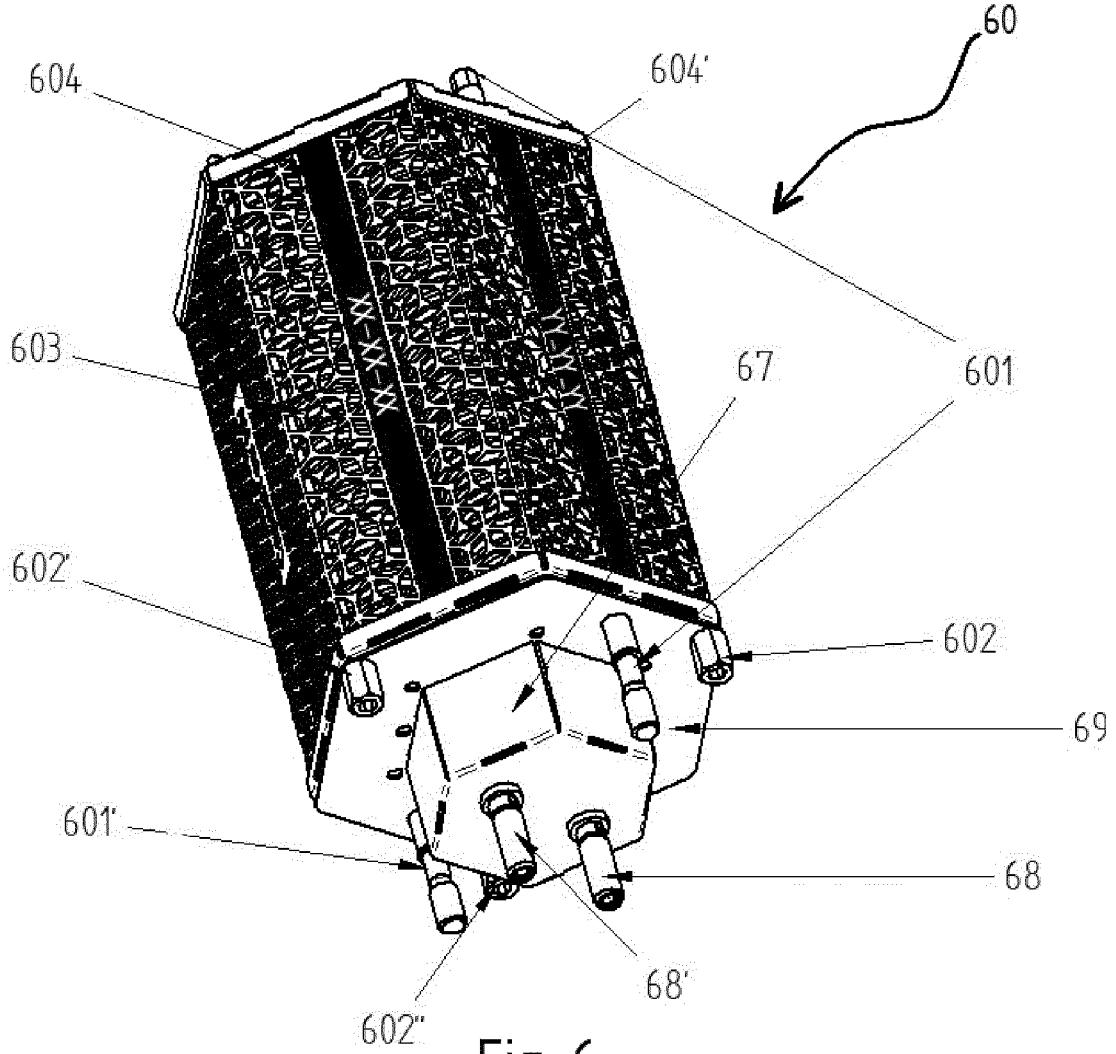

FIG. 5*a*, 5*b*, 5*c* are perspective schematic side views of three alternatives of heater module subassemblies suitable to be used in the snap-on getter pump according to present invention FIG. 6 is a perspective schematic side view of a snap-on getter pump according to the present invention, With regards to the above figures it is to be underlined that in order to improve their understandings, dimensions and dimensional ratios of certain elements in some cases may have been altered, with particular and nonexclusive reference to the number of windings of the heating wire around the cylindrical support. Also, in the following often reference is made to the diameter of some constitutional elements, although these elements may not be circular or may not have a circular cross-section, for example the heater module subassembly base diameter and the getter subassembly case bases; in these instances "diameter" is to be intended and interpreted as the diameter of the inscribing circle (the smallest circle encompassing the element or its cross-section). This is to take into account the most common alternate embodiments, still encompassed by the general concept of present invention, as already outlined, e.g. the getter subassembly case, and therefore its base, may not be cylindrical, but other shapes may be usefully adopted, such as polygons; this is preferred in case of more than three getter stacks, with the getter stacks in correspondence of the polygon vertexes.

Figure 1:
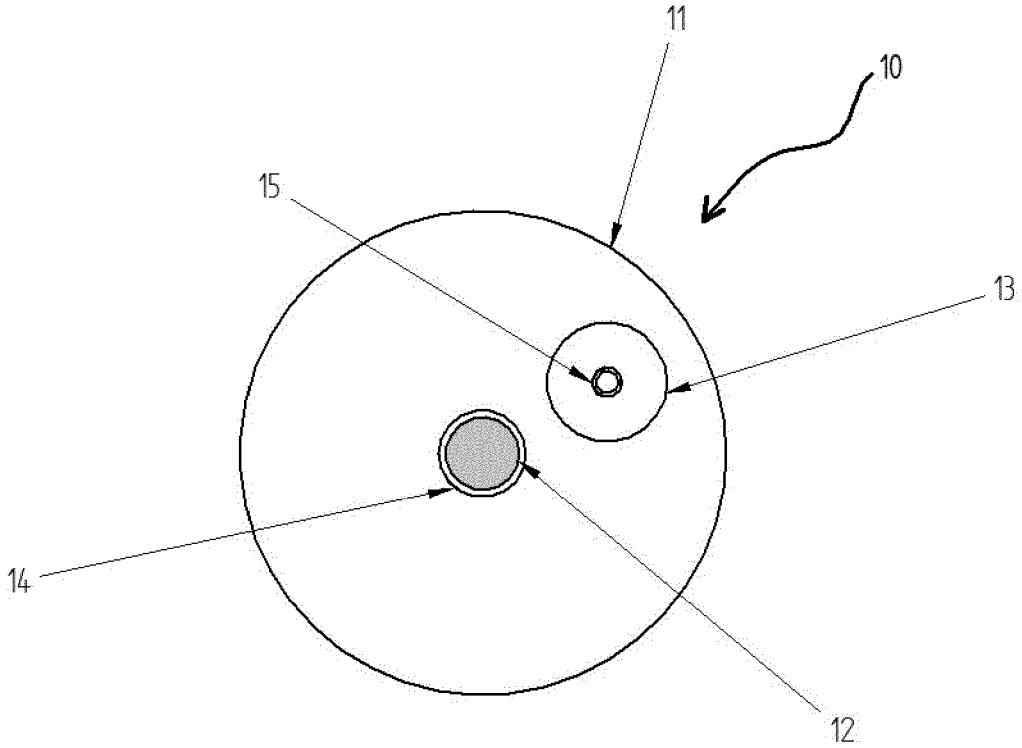
FIG. 1 is a schematic view from above of the inside of a getter module subassembly joined with a heater module subassembly, with only one getter stack present.

The most simple snap-on getter pump configuration according to the present invention is shown in the schematic representation of FIG. 1, where a getter module subassembly 10 has a circular base 11 (or more generally a base inscribable in a circle) and a heater module subassembly is inserted in the center of the circular base 11 and constituted by a cylindrical heater support 12 and one or more heating wires 14 wound upon it. A single getter stack has a plurality of getter disks 13 stacked upon a cylindrical getter support 15.

Figure 2:
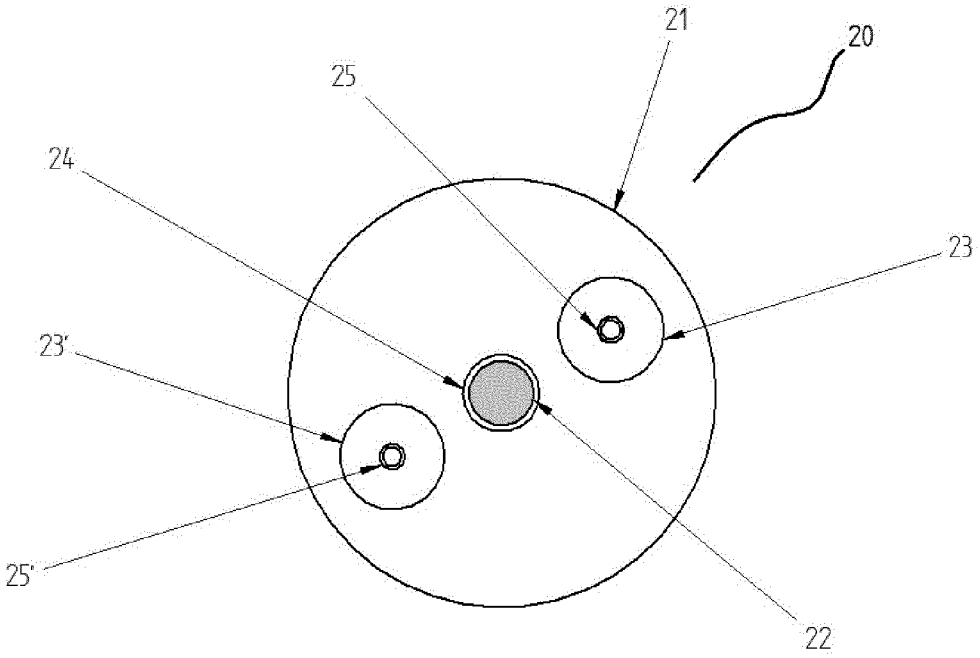
FIG. 2 is a schematic view from above of the inside of a getter module subassembly joined with a heater module subassembly, with two getter stacks present.

A first alternative snap-on getter pump configuration according to the present invention is shown in FIG. 2, where a getter module subassembly 20 has a circular base 21 (or more generally a base inscribable in a circle) and a heater module subassembly is inserted in the center of the circular base 21 and constituted by a cylindrical heater support 22 and one or more heating wires 24 wound upon it. Two getter stacks have a plurality of getter disks 23, 23' respectively stacked upon a cylindrical getter support 25, 25'.

Figure 3:
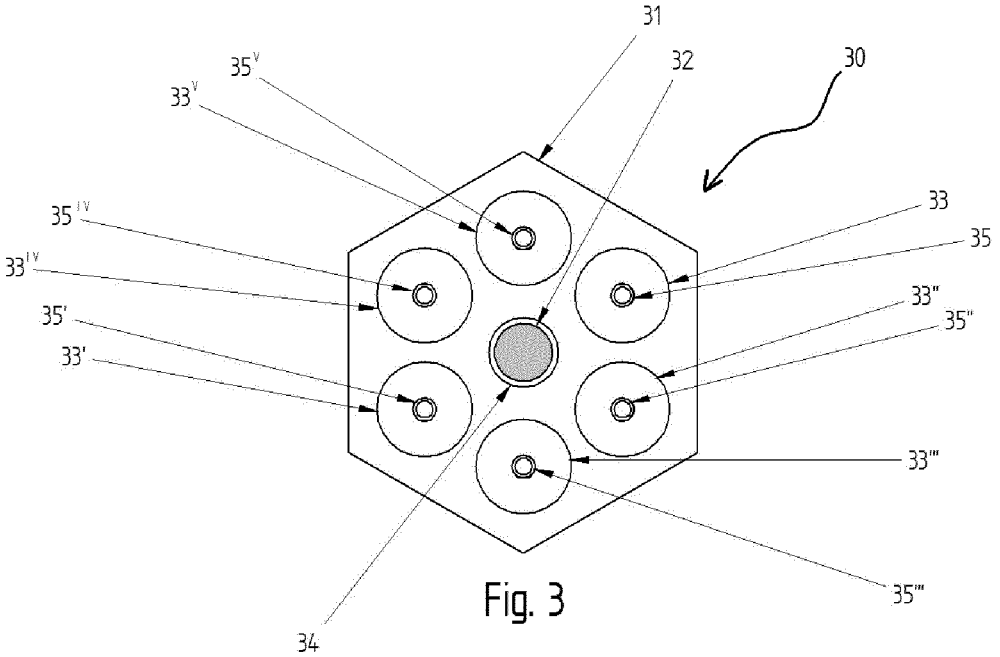
FIG. 3 is a schematic view from above of the inside of a getter module subassembly joined with a heater module subassembly, with six getter stacks present.

One of the preferred embodiments of the snap-on getter pump of the present invention is shown in FIG. 3, where a getter module subassembly 30 has a hexagonal base 31. A heater module subassembly is inserted in the center of the hexagonal base 31 and constituted by a cylindrical heater support 32 and one or more heating wires 34 wound upon it. Six getter stacks are disposed according to a circular pattern in which they are equally spaced from the cylindrical heater support 32. Each getter stack has a plurality of getter disks 33, 33', 33", 33''', $33^{IV}$, $33^{V}$ respectively stacked upon a cylindrical getter support 35, 35', 35", 35''', $35^{IV}$, $35^{V}$.

Figure 4:
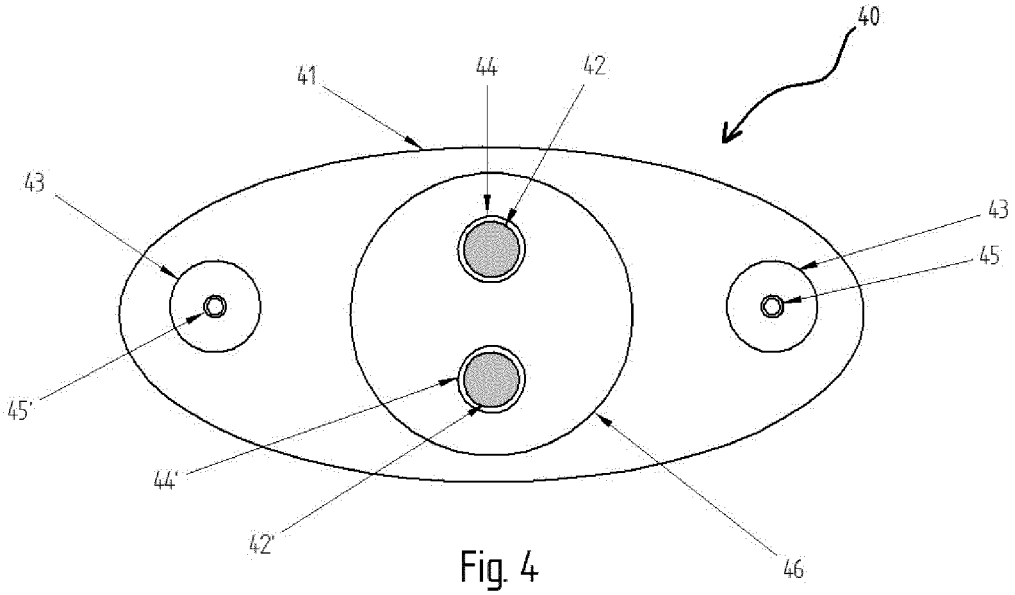
FIG. 4 is a schematic view from above of the inside of a getter module subassembly joined with two heater module subassemblies, with two getter stacks present.

Another possible alternative configuration of a snap-on getter pump according to the present invention is shown in FIG. 4, where a getter module subassembly 40 has an elliptical base 41 which has two getter stacks centered in its foci with a plurality of getter disks 43, 43' respectively stacked upon a cylindrical getter support 45, 45'. Another base 46, for example a circular base, is inserted in the elliptical base 41, and has two heater module subassemblies mounted on it, each constituted, as in the other embodiments, by a cylindrical heater support 42, 42' and one or more heating wires 44, 44' wound upon it, said heaters having the same distance from the circular base center. Once inserted, the circular base 46 is raised with respect to the elliptical base 41 and the centers of the two heaters are positioned along the minor axis of the elliptical base 41.

FIGS. 5*a*, 5*b*, 5*c* are schematic side views of three possible alternatives for the heater module subassemblies suitable to be used in a snap-on getter pump according to the present invention. FIG. 5*a* shows a heater module subassembly 50 with only one heating wire 54 wound on a cylindrical heater support 52, preferably with a pitch comprised between 1 and 2.5 mm. The heater is fixed on a first surface 59 of a base and on its opposite second surface there is a cable module 57 and two electrical connectors 58, with only electrical connector being visible because the other one is behind it.

In FIG. 5*b*, the heater module subassembly 50 is almost identical to that of FIG. 5*a*, the only difference being that there are two heating wires 54, 54' wound on the cylindrical heater support 52.

FIG. 5*c* shows the same embodiment of FIG. 5*b* with the addition of a hexagonal case 505 with a grid-like side wall that encloses the two heating wires 54, 54' wound on the cylindrical heater support 52. Moreover, a magnified view of a portion of case 505 with the two heating wires 54, 54' is shown on the right side for the same figure.

FIG. 6 shows a perspective view of a snap-on getter pump assembly 60 according to the present invention in a preferred embodiment, in which a heater module subassembly like that of FIG. 5*c* is inserted in a getter module subassembly like that of FIG. 3, which contains six getter stacks, with the addition of a case with a grid-like side wall 603 on its external surface, two metallic case bases fixed to the grid-like side wall 603 via holding frames placed on the metallic bases, with the base to be coupled to the heater module subassembly being holed in its center. The grid-like side wall 603 has one or more bands (only bands 604 and 604' being shown) in which the meshes of the grid are denser in order to have both an aesthetic and functional purpose; in fact, a logo, a serial number or other written references can be inserted (or shown) here.

The getter module subassembly and the heater module subassembly are firmly yet reversibly joined through their bases via three coupling elements 602, 602', 602" that in the present embodiment consist each of a tension rod (see dotted lines) extending from the top of the getter pump assembly 60, where it is retained by a Seeger ring, through the bases of the getter module subassembly and of the heater module subassembly so as to project downwards enough to be engaged by a relevant nut. In this way, the getter and heater modules subassemblies are firmly yet reversibly joined together, so that subsequent interventions are easily carried out (e.g. replacing the heater).

Moreover, there are two floating threaded rods 601, 601' which are similar to the tension rods of the coupling elements 602, 602', 602" (i.e. they also extend through the bases from the top of pump 60 where they are retained by Seeger rings) but they are longer since their purpose is to join firmly yet reversibly the assembled getter module subassembly and heater module subassembly to an external support through their lower threaded ends. Electrical connectors 68, 68' are present on the lower surface of the cable module 67 that is mounted on the lower surface 69 of the heater base (which is defined and represented in the drawings by its first surface 59 and second surface 69). Obviously, the coupling elements 602, 602', 602" must not interfere with the electrical connection and therefore do not project beyond the cable module 67, whereas the floating threaded rods 601, 601' must project beyond the cable module 67 by a sufficient amount to provide a firm screwing connection to the above-mentioned external support.

The maximum number of getter stacks within a single snap-on pumping element is preferably limited to 8 for high-speed pumps; a higher number, although possible, would render the assembly more complex (smaller diameter stacks) to keep the pump volume compact, or if pump volume is increased to accommodate more stacks than there could be drawbacks in thermal management of the most peripheral getter stacks, not to mention additional requirements and complexity for the heater module.

The getter stacks are disposed to leave a central empty space inscribable in a circle of diameter D, preferably comprised between 20 and 70 mm. Smaller empty space diameters are useful for the most compact pumps, since the lower available space will imply smaller and less powerful heaters. Preferably, the one or more heaters have dimensions such that their cross-section is inscribable in a circle having a diameter comprised between 0.5 and 0.9 times D.

Most typically, the total inner free volume of the getter module subassembly, once coupled with the heater module subassembly, is comprised between 50 and 500 $cm^3$, and this provides a limit to the number and size of active elements (getters and heaters), installed or insertable within.

With regards to the heater module subassembly, the specific constitution of the heating elements is known to a person skilled in the art; most commonly, the heater comprises a cylindrical ceramic support, usually of diameter comprised between 10 and 50 mm, made with a refractory material, such as alumina or high temperature machine glass ceramic such as MACOR®, with one or more heating wires wound upon it. The most common and more useful materials for the heating wires are tantalum, molybdenum or tungsten (pure or alloyed), with a diameter comprised between 0.3 mm and 0.8 mm.

The present invention is not limited to a specific type on Non Evaporable Getter (NEG) material, and those are known to a person skilled in the art, as for example described in U.S. Pat. Nos. 8,961,816, 9,416,435, and 6,521,014 and more in general Zr-based alloy or Ti-based alloys, i.e. alloys where this element is the most abundant in the composition.

The term "getter stack" indicates and encompasses generic vertical structures holding getter material and, as shown in the various figures, does not encompass a heater as support but just a plain passive holder, as the heater is instead solely present in the heater module subassembly. The present invention is not limited to a specific type of getter stack, useful ones are such as for example described in U.S. Pat. No. 3,662,522, even though the most common and preferred structure is given by disks of sintered getter material fixed onto a central rod, as described for example in U.S. Pat. No. 6,149,392. Preferably, the getter stacks employed in the snap-on getter pump according to the present invention have a height comprised between 80 and 200 mm and a diameter comprised between 20 and 50 mm. The height of the getter stacks (preferably equal to each other) determines also the most useful height of the getter heater(s) that is/are ideally of the same height of the stacks (or their average height in the less preferred case of meaningful discrepancies in getter stacks height), even though a 20% difference only marginally affects performances.

Finally, it is also important to underline that it is not strictly necessary to have a shape matching between the getter module subassembly case base and the heater module subassembly base, as long as the heater module subassembly base shape is geometrically compliant with its corresponding getter module subassembly base, namely the aperture in the getter module subassembly base should allow the insertion of the heater, and there is a sufficient overlap between the getter module subassembly base and the heater module subassembly base for their firm joining.

Preferably, there is a shape matching (for example hexagonal versus hexagonal) as this solution provides an easier installation, as well as for a purely aesthetic reason, whereas a standard shape for the heater subassembly, such as the circular one, could be "universally" adopted on different getter subassemblies.

The side wall of the getter module subassembly for all the embodiments of snap-on getter pumping elements according to the present invention is essentially made by a grid-like element 603, preferably metallic, with a void to fill ratio comprised between 0.3 and 0.7 to ensure a good compromise between mechanical protection of the getter stacks (for example during shipment, handling and installation) and not impairing the module pumping speed. A grid-like element is preferably also present in the internal boundary of the getter module subassembly (the part facing the one or more heaters).

Similarly, the heater module subassembly 50 is encased with a grid-like element 505 fixed to its base for the same protection purposes, in particular to avoid damage or dislodge (with the risk of creating short-circuits) of the heating wires 54, 54'. The presence of grid-like walls on both the inner part of the getter module subassembly and the external part of the heater module subassembly 50, ensures that during insertion of the heater module subassembly 50 into the getter module subassembly there is no accidental contact between the getter stacks and the one or more heaters, which is especially advantageous with longer snap-on getter pumping elements.

Preferably all the grid-like side walls have void to fill ratio comprised between 0.3 and 0.7. It is to be underlined that such grid-like walls may be different from each other, for example the one acting as external interface of the getter module having the highest void to fill ratio (no impact on pumping speed), whereas the one on the inner side as well as on the heater module subassembly having a lower void to fill ratio (higher protection).

The closed cable module, that represents the part that is "snapped-on" onto a suitable external support, provides both mechanical stability and allows current supply to the heating wire(s). This module presents, in its bottom part, matching plug-and-socket electrical connections with respect to the one present on the support; preferably, the closed cable module presents between two and four plugs, and most preferably such plugs have a length comprised between 10 mm and 50 mm and a diameter comprised between 3 mm and 10 mm, to help also in stabilizing the module during the installation phase.

In a particularly preferred embodiment, the closed cable module is integrated into the bottom surface 69 of the heater base.

It is evident to a person of ordinary skill in the art that the detailed solutions shown in the previously described figures could be suitably combined, giving rise to other configurations still encompassed by the present invention. For example, the one or more bands on the grid-like side wall could be used also with any number of getter stacks contained in the getter module subassembly. Also, some embodiments immediately derivable from the ones already shown have not been depicted as trivial modifications; in particular, the present invention is not limited to a specific number of getter stacks or heaters or coupling elements as long as they fulfill the requirements specified in claim 1 in terms of final coupling between getter and heater modules subassemblies.

Similarly, mechanically equivalent members can be used to replace any of the specific elements described in the previous embodiments. For example, the coupling elements 602, 602', 602" could be different from the Seeger ring-tension rod-nut configuration described above, as long as they perform their function of reversibly coupling the getter and heater modules subassemblies.

In a second aspect thereof, the invention consists in a getter pumping system installation comprising a plurality of snap-on getter pumping elements mounted on a metallic holder capable to hold such plurality of snap-on getter pumping elements. The number of such snap-on getter pumping elements per holder is usefully comprised between 2 and 256.

The metallic holder has a front and back surface, with different purposes. The front surface presents electrical connectors matching the ones on the closed cable modules 57, 67 as well as fixing means for the floating threaded rods 601, 601'. The back surface has the purpose to fix in place the metallic holder to an external element, such as a wall or a suitable support structure directly or by means of other interposed metallic sheets. Those optional sheets, acting as separators, may fulfill different functions, e.g. they may provide an interspace for the electrical distribution circuits, or in case of a removable sheet, a temporary protection for shipment.

In view of the above, the most useful configurations envision up to two additional metallic sheets for a metallic holder according to the present invention. It is to be underlined that an assembled structure comprising a metallic holder and one or more optional sheets has at least one, preferably all, of its sides open to ease interspace evacuation.

The most common and useful configurations for the metallic holder envision the metallic holder to be planar or having a curvature with a radius comprised between 0.5 m and 3 m.

Most usefully, the thickness of the metallic holder (intended as average thickness) is comprised between 2 and 15 mm, that is also the preferred (average) thickness for the other optional metallic sheets of the metallic holder.

The combined use of a snap-on getter pump and of a metallic holder according to the present invention allows to have a conformable pumping system, comprising a completely configurable disposition of blocks of snap-on getter pumping elements, also defined thanks to the modularity of their metallic holders that can be adjusted to fit into different frames and spatial constraints.

In this regard, it is important to underline that when more metallic holders are joined together via suitable mechanical coupling means keeping the metallic holders spaced apart with no direct contact point between them, this ensures that there is a good evacuation of the interspace between the metallic holder back surface and the wall or a suitable support structure where the metallic holders are mounted; at the same time, the distance between adjacent elements is not excessive, which would result in less efficient systems.

In a preferred embodiment, the support structure is circular so that the conformable pumping system is ring-shaped.

The invention claimed is:

1. A snap-on getter pumping element, comprising a getter module subassembly, and a heater module subassembly that are firmly but reversibly joined through coupling elements, and a closed cable module that has electrical connectors, wherein:

the getter module subassembly comprises one or more getter stacks and has a case with a side wall on its external surface and two metallic case bases fixed to the side wall, with a base to be coupled to the heater module subassembly being holed in its center, the one or more getter stacks being disposed around a central empty space inscribable in a circle with diameter D within the getter module subassembly case;

the heater module subassembly comprises one or more heaters mounted in a central position of a first surface of a heater module subassembly base, the one or more heaters being insertable in the central empty space of the getter module subassembly case via the holed getter subassembly base;

the side wall is grid-like;

the closed cable module is mounted on a second surface of the heater module subassembly base, opposite to the first surface, and the electrical connectors are located on its surface opposite with respect to the one in contact with the heater module subassembly;

at least two floating threaded rods project from the second surface of the heater subassembly base; and the coupling elements do not project beyond the closed cable module, whereas the floating threaded rods project beyond the closed cable module by a sufficient amount to provide a firm screwing connection to an external support while allowing the electrical connectors to connect with matching plug-and-socket electrical connections present on the external support.

2. The snap-on getter pumping element according to claim 1, wherein a grid-like side wall is present also on a boundary of the central empty space of the getter module subassembly.

3. The snap-on getter pumping element according to claim 1, wherein the closed cable module is integrated into the second surface of the heater module subassembly base.

4. The snap-on getter pumping element according to claim 1, wherein the metallic case bases and the grid-like side wall are fixed via holding frames placed on the metallic case bases.

5. The snap-on getter pumping element according to claim 1, wherein the metallic case bases and the grid-like side wall are fixed through tension rods extending beyond the bases and secured by Seeger rings and/or nuts.

6. The snap-on getter pumping element according to claim 5, wherein the getter module subassembly and heater module subassembly are reversibly joined by threaded nuts screwed onto lower extremities of the tension rods.

7. The snap-on getter pumping element according to claim 1, wherein the number of getter stacks is between 1 and 8.

8. The snap-on getter pumping element according to claim 1, wherein the central empty space surface is inscribable in a circle with diameter D between 20 mm and 70 mm.

9. The snap-on getter pumping element according to claim 1, wherein the one or more heaters cross-section is inscribable in a circle whose diameter is between 0.5 and 0.9 times D.

10. The snap-on getter pumping element according to claim 1, wherein the grid-like side wall has a void to fill ratio between 0.3 and 0.7.

11. The snap-on getter pumping element according to claim 1, wherein a total inner free volume of the getter module subassembly, once coupled with the heater module subassembly is between 50 and 500 $cm^3$.

12. The snap on getter pumping element according to claim 1, wherein each of the one or more getter stacks and each of the one or more heaters has a height between 80 and 200 mm.

13. The snap on getter pumping element according to claim 12, wherein the height of the one or more getter stacks has an average value that differs from the height of the one or more heaters by no more than 20% of the average value.

14. The snap on getter pumping element according to claim 1, wherein the coupling elements are tension rods protruding from the getter module subassembly to be inserted into corresponding holes into the base of the heater module subassembly.

15. The snap on getter pumping element according to claim 1, wherein the number of the floating threaded rods is between 2 and 4.

16. The snap on getter pumping element according to claim 1, wherein the one or more heaters comprise a ceramic support with a heating wire spirally wound upon it.

17. The snap on getter pumping element according to claim 16, wherein the one or more heaters comprise a second heating wire.

18. The snap on getter pumping element according to claim 16, wherein the one or more heaters are encased in a protecting element.

19. The snap on getter pumping element according to claim 1, wherein the closed cable module electrical connectors are plugs for matching external socket connectors.

20. The snap on getter pumping element according to claim 19, wherein the number of plugs is between 2 and 4.

21. A getter pumping system installation comprising a plurality of snap-on getter pumping elements according to claim 1, wherein the snap-on getter pumping elements are mounted on a metallic holder with a front surface having electrical connectors matching the ones on the snap-on getter pump closed cable modules and to which the floating threaded rods are fixed, and a back surface for mounting the metallic holder onto an external element.

22. The getter pumping system installation according to claim 21, wherein the metallic holder is mounted onto the external element either directly or through at least one interposed metallic sheet.

23. The getter pumping system installation according to claim 21, wherein a thickness of the metallic holder and/or of the interposed metallic sheet is between 2 mm and 15 mm.

24. The getter pumping system installation according to claim 21, wherein the metallic holder is planar or is curved with a radius between 0.5 m and 3 m.

25. The getter pumping system installation according to claim 21, comprising between 2 and 256 snap-on getter pumping elements.

26. A method for assembling a pumping system comprising mounting between 2 and 64 getter pumping system installations according to claim 21, wherein each getter pumping system installation is spaced apart with no direct contact point with the adjacent ones.

27. The method for assembling a pumping system according to claim 26, wherein the getter pumping systems installations are mounted on an external wall supporting structure.

* * * * *